US009166350B2

(12) United States Patent
Zhang et al.

(10) Patent No.: US 9,166,350 B2
(45) Date of Patent: Oct. 20, 2015

(54) HYBRID ELECTRICAL CONNECTOR

(71) Applicants: Tyco Electronics (Shanghai) Co., Ltd., Shanghai (CN); Tyco Electronics Japan G.K., Kawasaki-shi, Kanagawa-ken (JP)

(72) Inventors: Shihao Zhang, Shanghai (CN); Hiroshi Shirai, Kawasaki (JP); Xiang Xu, Shanghai (CN); Biaobing Lv, Shanghai (CN)

(73) Assignees: Tyco Electronics (Shanghai) Co. Ltd., Shanghai (CN); Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/219,739

(22) Filed: Mar. 19, 2014

(65) Prior Publication Data

US 2014/0287628 A1 Sep. 25, 2014

(30) Foreign Application Priority Data

Mar. 19, 2013 (CN) ..... 2013 2 0125592

(51) Int. Cl.
*H01R 24/76* (2011.01)
*H01R 27/00* (2006.01)

(52) U.S. Cl.
CPC ..... *H01R 27/00* (2013.01)

(58) Field of Classification Search
CPC ..... H01R 13/6471; H01R 23/7073; H01R 23/668
USPC ..... 439/660, 924.1, 941
See application file for complete search history.

(56) References Cited

U.S. PATENT DOCUMENTS

| | | | | |
|---|---|---|---|---|
| 5,674,093 | A * | 10/1997 | Vaden | 439/676 |
| 6,334,792 | B1 * | 1/2002 | Schmidt et al. | 439/676 |
| 6,896,523 | B2 * | 5/2005 | Nishizawa et al. | 439/60 |
| 7,232,346 | B2 * | 6/2007 | Hu et al. | 439/660 |
| 7,267,583 | B1 * | 9/2007 | Smith et al. | 439/660 |
| 7,967,641 | B2 * | 6/2011 | Miyoshi | 439/660 |
| 8,708,718 | B2 * | 4/2014 | Li et al. | 439/108 |
| 2011/0250800 | A1 * | 10/2011 | Guo | 439/660 |
| 2012/0009823 | A1 * | 1/2012 | Lapidot et al. | 439/626 |
| 2012/0115371 | A1 * | 5/2012 | Chuang et al. | 439/660 |
| 2013/0059460 | A1 * | 3/2013 | Sasame | 439/345 |
| 2013/0149906 | A1 | 6/2013 | Kim et al. | |

* cited by examiner

*Primary Examiner* — Tho D Ta
(74) *Attorney, Agent, or Firm* — Barley Snyder

(57) ABSTRACT

A connector is disclosed with an insulating body. A plurality of contacts are positioned in the insulating body. The plurality of contacts include a group of first contacts with a first length, and a group of second contacts with a second length less than the first length. Each second contact is positioned in a gap between two adjacent first contacts.

11 Claims, 3 Drawing Sheets

HYBRID ELECTRICAL CONNECTOR

CROSS-REFERENCE TO RELATED APPLICATION

This application claims the benefit of the filing date under 35 U.S.C. §119(a)-(d) of Chinese Patent Application No. 201320125592, filed on Mar. 19, 2013.

FIELD OF THE INVENTION

The present invention relates to a connector, more particularly, relates to a hybrid Universal Serial Bus (USB) connector compatible with Micro USB communication and USB3.0 communication.

BACKGROUND

Hybrid USB connectors are compatible with Micro USB connectors, such as Micro USB2.0, and USB3.0. The hybrid USB connectors have a group of first contacts for transmitting Micro USB signals and a group of second contacts for transmitting USB3.0 signals.

FIG. 1 shows a conventional hybrid USB connector having an insulating body 10 and a plurality of contacts 1, 2, 3, 4, 5, 6, 7, 8, 9 positioned in the insulating body 10. Although not shown, the conventional hybrid USB connector further includes a metal shield enclosing the insulating body 10.

FIG. 2 shows the plurality of contacts of FIG. 1, where a group of first contacts 3, 4, 5, 6, 7 transmits Micro USB signals and a group of second contacts 1, 2, 8, 9 transmits USB3.0 signals.

The group of first contacts 3, 4, 5, 6, 7 are positioned in a row. The group of second contacts 1, 2, 8, 9 have a first pair of differential signal contacts 1, 2 and a second pair of differential signal contacts 8, 9 positioned on opposing sides of the group of first contacts, respectively.

Each of the first contacts 3, 4, 5, 6, 7 have a length larger than a length of each of the second contacts 1, 2, 8, 9.

Since the lengths of the first and second contacts are limited to the overall size of the connector, only the contacts for transmitting USB signals are provided in the conventional hybrid USB connector. No additional function contacts such as signal detection contacts or signal test contacts are used, which limits the utility of the conventional hybrid USB connector.

SUMMARY

It is therefore an object of the invention to provide a connector having more contacts than a conventional connector, without increasing the overall size of the connector. A connector is disclosed with an insulating body. A plurality of contacts are positioned in the insulating body. The plurality of contacts include a group of first contacts with a first length, and a group of second contacts with a second length less than the first length. Each second contact is positioned in a gap between two adjacent first contacts.

BRIEF DESCRIPTION OF THE DRAWINGS

The invention will now be described by way of example with reference to the accompanying drawings, of which.

DETAILED DESCRIPTION

Exemplary embodiments of the present disclosure will now be described in detail with reference to the attached drawings. The present disclosure is only illustrative, and may be embodied in many different forms and should not be construed as being limited to the exemplary embodiments. These embodiments are provided so that the present disclosure will be thorough and complete, and will fully convey the concept of the disclosure to those skilled in the art.

Figure 1:
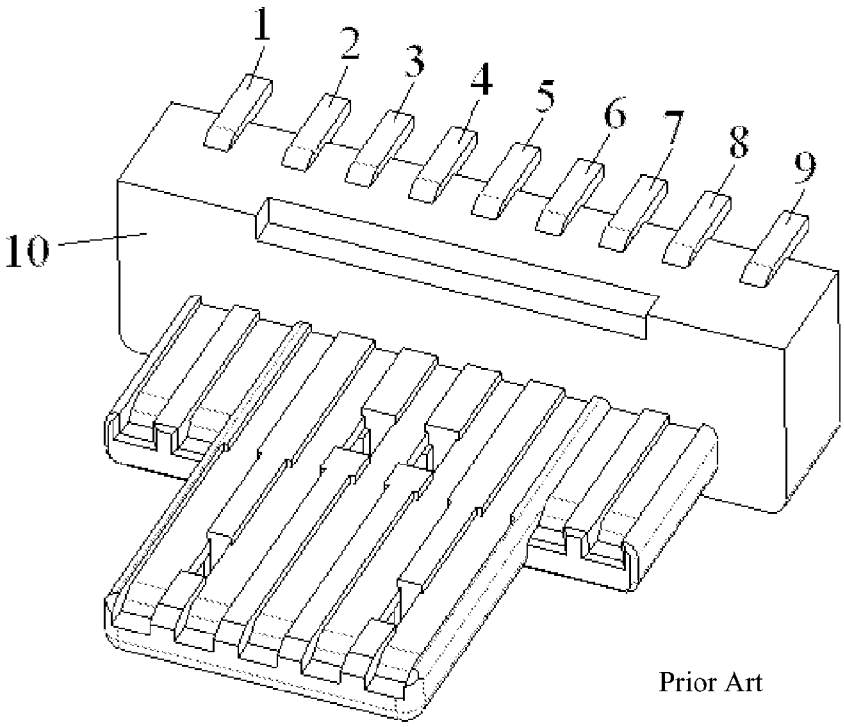
FIG. 1 is an illustrative view of a conventional hybrid USB connector.
Figure 2:
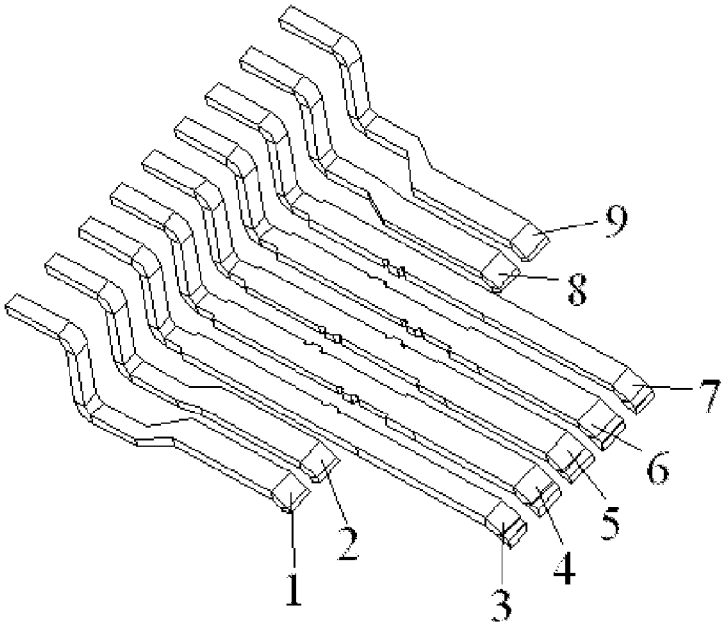
FIG. 2 is an illustrative spatial arrangement view of a plurality of contacts of the conventional hybrid USB connector in FIG. 1.
Figure 3:
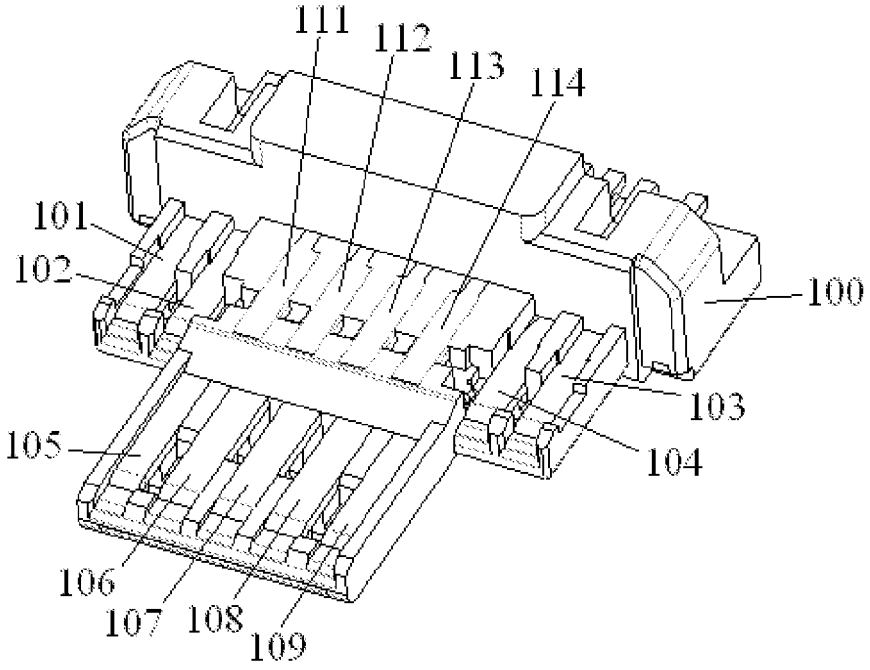
FIG. 3 is an illustrative perspective view of an embodiment of a connector according to the present invention.
Figure 4:
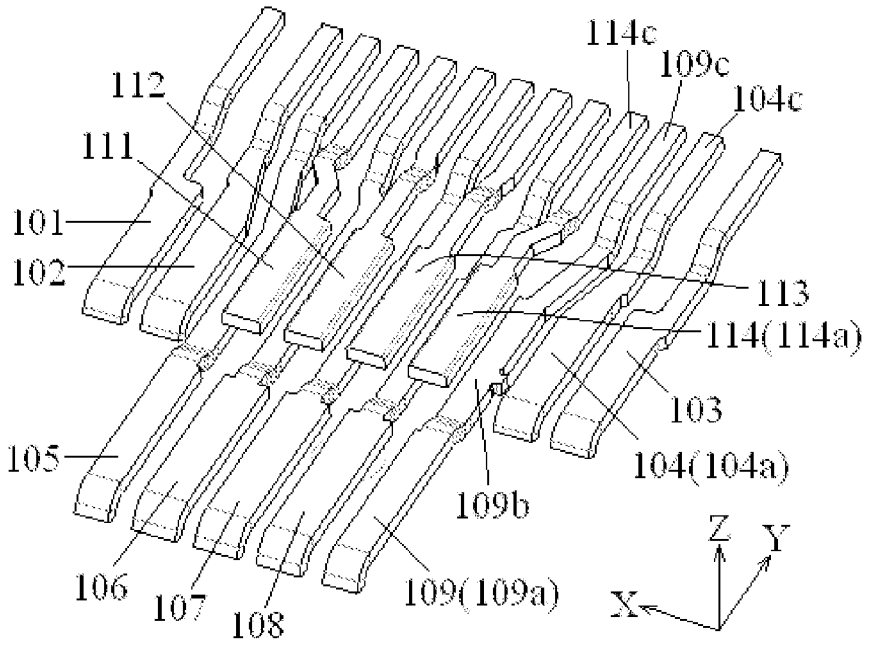
FIG. 4 is an illustrative spatial arrangement view of a plurality of contacts of the connector in FIG. 3.
Figure 5:
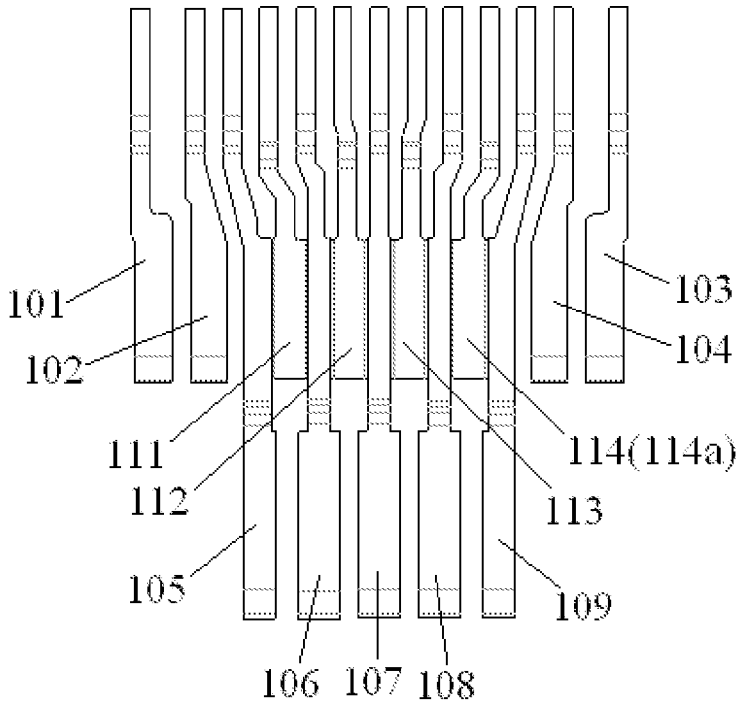
FIG. 5 is a top view of the plurality of contacts in FIG. 4.

An exemplary embodiment of a connector according to the invention is disclosed in FIGS. 3 to 5 having an insulating body 100 and a plurality of contacts 101-109, 111-114 positioned in the insulating body 100. In another embodiment, the connector further includes a metal shield (not shown) surrounding and enclosing the insulating body 100.

The plurality of contacts 101-109, 111-114 includes: a group of first contacts 105-109 having a first length extending in a longitudinal direction Y of the connection; and a group of second contacts 111-114 having a second length less than the first length, and extending in the longitudinal direction Y. Each second contact in the group of second contacts 111-114 is positioned in a gap between two adjacent first contacts of the group of first contacts 105-109.

All of the plurality of contacts 101-109, 111-114 can be positioned and fixed in the insulating body 100 at the same time, through an over molding process.

Referring to FIGS. 3 to 5, the second length of each of the second contacts 111-114 is less than the first length of each of the first contacts 105-109. Each second contact in the group of second contacts 111-114 is positioned in a gap between two adjacent first contacts of the group of first contacts 105-109. As shown in FIGS. 4 and 5, the second contact 111 is positioned in a gap between two adjacent first contacts 105, 106; the second contact 112 is positioned in a gap between two adjacent first contacts 106, 107; the second contact 113 is positioned in a gap between two adjacent first contacts 107, 108; and the second contact 114 is positioned in a gap between two adjacent first contacts 108, 109. In these embodiments, by utilizing the gaps between the first contacts 105-109 having the longest length, functional contacts like the second contacts 111-114 for transmitting signals can be provided without increasing the size of the connector. Accordingly, the available applications of the connector can be expanded to provide more functions for the user to selection than before, and it is very convenient for the user.

As also shown in FIGS. 3 to 5, the plurality of contacts 101-109, 111-114 further include a group of third contacts 101-104 having a third length extending in the longitudinal direction Y of the connector.

The third contacts 101-104 are positioned on opposing sides of the group of first contacts 105-109. In an exemplary embodiment, the third length of the third contacts 101-104 is less than the first length of the first contacts 105-109 and larger than or equal to the second length of the second contacts 111-114.

Each of the first contacts 105-109 includes a first contact portion, a first leg portion, and a first connection portion extending between the first contact portion and the first leg portion. In an exemplary embodiment, the first contact 109 has a first contact portion 109*a*, a first leg portion 109*c*, and a first connection portion 109*b* extending between the first contact portion 109*a* and the first leg portion 109*c*.

Each of the second contacts 111-114 includes a second contact portion, a second leg portion, and a second connection portion extending between the second contact portion and the second leg portion. In an exemplary embodiment, the second contact 114 has a second contact portion 114*a*, a second leg portion 114*c*, and a second connection portion extending between the second contact portion 114*a* and the second leg portion 114*c*.

The second contact portion of each of the second contacts 111-114 is positioned between and above the first connection portions of two adjacent first contacts of the first contacts 105-109. In an exemplary embodiment, the second contact portion 114*a* of the second contact 114 is positioned between and above the first connection portions of two adjacent first contacts 108, 109. That is, the second contact portion 114*a* is positioned between the first connection portions of two adjacent first contacts 108, 109 in a width X direction of the connector, and the second contact portion 114*a* is positioned above the first connection portions of two adjacent first contacts 108, 109 in a height direction Z of the connector.

As shown in FIG. 5, the second contact portion of each of the second contacts 111-114 has a width substantially equal to or less than a width of the gap between two adjacent first contacts of the first contacts 105-109. In an exemplary embodiment, the second contact portion 114*a* of the second contact 114 has a width substantially equal to or less than a width of the gap between two adjacent first contacts 108, 109. As a result, the width of second contact portion of the second contact can be maximized in the width direction.

The first contact portion of each of the first contacts 105-109 and the second contact portion of each of the second contacts 111-114 are positioned in one plane perpendicular to a height direction of the connector. For example, in the exemplary embodiment shown in FIG. 4, the first contact portion 109*a* of the first contact 109 and the second contact portion 114*a* of the second contact 114 are positioned in one plane perpendicular to the height direction of the connector.

Each of the third contacts 101-104 includes a third contact portion, a third leg portion, and a third connection portion extending between the third contact portion and the third leg portion. In an exemplary embodiment, the third contacts 104 has a third contact portion 104*a*, a third leg portion 104*c*, and a third connection portion extending between the third contact portion 104*a* and the third leg portion 104*c*.

The first connection portion of each of the first contacts 105-109 and the third contact portion of each of the third contacts 101-104 are positioned in one plane perpendicular to the height direction of the connector. For example, in an exemplary embodiment the first connection portion 109*b* of the first contact 109 and the third contact portion 104*a* of the third contact 104 are positioned in one plane perpendicular to the height direction of the connector.

The first leg portions, the second leg portions and the third leg portions are positioned in a row and in one plane perpendicular to the height direction of the connector. For example, in an exemplary embodiment the first leg portion 109*c*, the second leg portion 114*c* and the third leg portion 104*c* are positioned in a row and positioned in one plane perpendicular to the height direction of the connector. With this arrangement, the first, second and third contacts can be positioned level on a circuit board (not shown) and soldered thereto.

The group of first contacts 105-109, the group of second contacts 111-114 and the group of third contacts 101-104 can perform different functions, respectively. In an exemplary embodiment, the group of first contacts 105-109 transmit Micro USB signals; the group of third contacts 101-104 transmit USB3.0 signals; and the group of second contacts 111-114 are signal detection contacts or signal test contacts.

In the above embodiments, since each second contact of the group of second contacts is positioned in a gap between two adjacent first contacts of the group of first contacts, the total number of the contacts of the connector can be increased without increasing the size of the connector. For example, signal detection contacts or signal test contacts can be incorporated into the connector in addition to the contacts for transmitting USB signals without increasing the size of the connector. Accordingly, the application of the above disclosed connector can be expanded to provide more selective functions for the user than those offered by conventional connectors.

It should be appreciated for those skilled in this art that the above embodiments are intended to be illustrated, and not restrictive. In the above exemplary embodiments, many modifications may be made those of ordinary skill the art, and various features described in different embodiments may be freely combined with each other without conflicting in configuration or principle, so that more kinds of connector can be achieved with overcoming the technical problem of the present invention.

Although several exemplary embodiments have been shown and described, it would be appreciated by those of ordinary skill in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

an insulating body; and a plurality of contacts positioned in the insulating body and having a group of first contacts with a first length and first contact portions, each first contact being adjacently positioned next to another first contact with a gap disposed therebetween, and a group of second contacts with a second length less than the first length and second contact portions, one second contact being solely positioned in each gap between adjacent first contacts, and the first contact portions and the second contact portions being positioned in one plane perpendicular to a height direction of the connector.

2. The connector of claim 1, wherein the plurality of contacts further comprises a group of third contacts positioned on opposing sides of the group of first contacts, and having a third length.

3. The connector of claim 1, wherein each of the first contacts includes a first contact portion, a first leg portion, and a first connection portion extending between the first contact portion and the first leg portion; and each of the second contacts includes a second contact portion, a second leg portion, and a second connection portion extending between the second contact portion and the second leg portion.

4. The connector of claim 3, wherein the second contact portion of each of the second contacts is positioned between and above the first connection portions of two adjacent first contacts.

5. The connector of claim 4, wherein the second contact portion of each of the second contacts has a width substantially equal to or less than a width of the gap between two adjacent first contacts.

6. The connector of claim 2, wherein the third length is less than the first length and larger than or equal to the second length.

7. The connector of claim 3, wherein each of the third contacts includes a third contact portion, a third leg portion, and a third connection portion extending between the third contact portion and the third leg portion.

8. The connector of claim 7, wherein the first connection portions and the third contact portions are positioned in one plane perpendicular to the height direction of the connector.

9. The connector of claim 8, wherein the first leg portions, the second leg portions, and the third leg portions are positioned in a row and in the one plane perpendicular to the height direction of the connector.

10. The connector according to claim 9, wherein the group of first contacts, the group of second contacts and the group of third contacts carry different signals.

11. The connector of claim 10, wherein the group of first contacts are Micro USB signal transmitters; the group of third contacts are USB3.0 signal transmitters; and the group of second contacts are signal detection contacts or signal test contacts.

* * * * *